US005492656A

United States Patent [19]

Tracy

[11] Patent Number: 5,492,656

[45] Date of Patent: Feb. 20, 1996

[54] APPARATUS AND METHOD FOR MANHOLE COLLAR CONSTRUCTION

[76] Inventor: Mark Tracy, 10506 Farner Rd., Nampa, Id. 83686

[21] Appl. No.: 270,759

[22] Filed: Jul. 5, 1994

[51] Int. Cl.[6] ..... B28B 7/16; B28B 7/28; E04B 1/16

[52] U.S. Cl. ..... 264/32; 249/96; 249/97; 249/142; 249/177; 264/35; 264/278

[58] Field of Search ..... 264/32, 35, 274, 264/275, 278, 279, 279.1; 249/96, 97, 142, 177

[56] References Cited

U.S. PATENT DOCUMENTS

| | | | |
|---|---|---|---|
| 3,313,515 | 4/1967 | Mullen, Jr. | 249/177 X |
| 4,406,439 | 9/1983 | Garter | 264/32 X |
| 4,536,103 | 8/1985 | Prescott | 264/32 X |

*Primary Examiner*—Karen Aftergut
*Attorney, Agent, or Firm*—Ken J. Pedersen; Barabara S. Pedersen

[57] ABSTRACT

Apparatus and method for constructing a manhole collar between an existing manhole cone and a precast manhole ring. The apparatus includes a circular slip form tube, tapered from a larger top diameter to a smaller bottom diameter; at least two support arms, radially extending from adjacent the top of the slip form tube for placement on a support surface, such as a road surface, to hold the tube at a selected height relative to ground level within a manhole cone; and a plurality of fasteners for attachment of a precast manhole ring about the exterior periphery of the slip form tube for supporting the ring at a selected height relative to the manhole cone and the roadway surface. The apparatus may include a concrete spill retention ring, placeable upon the top rim of the manhole cone and around the slip form tube to prevent concrete from entering the manhole cone. The method of the invention includes the steps of supporting the slip form tube upon the roadway surface by the arms; fastening the manhole ring to the tube for proper positioning thereof; leveling the tube and ring; and the pouring of concrete about the slip form tube to form a ring-supporting concrete collar between the manhole cone and the manhole ring.

15 Claims, 2 Drawing Sheets

APPARATUS AND METHOD FOR MANHOLE COLLAR CONSTRUCTION

BACKGROUND OF THE INVENTION

1. Field of the Invention

This invention relates to slip forms, in general, and, more particularly to slip forms for the construction of manhole and water pipe collars, in particular.

2. Description of the Prior Art

Presently, manhole assemblies are generally constructed of a precast cylindrical barrel, with top opening, the barrel provided at its base with ports for connecting to existing sewer lines; a precast manhole cone placed upon the barrel; a series of precast riser rings of varying heights, placed upon the cone to bring the manhole assembly to a desired height relative to a road surface; and finally a precast manhole ring, of standard height, placed upon the risers to bring the manhole ring to a proper height for placement of a manhole cover therein. The top of the manhole ring is generally positioned one-quarter of an inch below the top of the road surface, which is generally constructed of asphalt or concrete. An annular void is left about the risers and ring for the pouring of a concrete collar to present a nearly flush surface with the surrounding road surface.

In the precast risers and manhole ring are provided in standard heights, an exact elevation cannot be achieved using the precast products and therefore it is common to use small spacer blocks between risers or between risers and ring to bring the assembly to an exact height. Such construction is time consuming; expensive in the provision of precast rings; and is time consuming to the construction crew, often requiring grout to be placed between overlying riser rings and between riser rings and the manhole ring.

SUMMARY OF THE INVENTION

The present invention overcomes these problems in the prior art by providing apparatus which holds the manhole ring at a precise height and level and which enables a concrete collar to be poured between a precast manhole cone and a precast manhole ring, thus eliminating the cost of precast risers; eliminating the intricate work of bringing the risers and hence the manhole ring to proper level; and, at the same time, embedding the manhole ring in concrete to secure the precise height at which it has been held by the apparatus. The present invention also provides a method for construction of such a collar.

The apparatus includes a slip form tube, tapered from top to bottom, and circular in cross-section, for insertion into a manhole cone; a plurality of arms radially and perpendicularly extending from the slip form tube for supporting the apparatus on the surrounding road surface; and fasteners for attaching a precast manhole ring about the periphery of the slip form tube for holding the ring at a precise height for the pouring of concrete to form a collar between the manhole cone and the ring. The method of the present invention includes the steps of supporting the slip form tube; of fastening the manhole ring to the tube; the leveling of tube and ring at a precise height; and the pouring of concrete to form a collar which holds the manhole ring at its precise height; and then the loosening of the fasteners holding the manhole ring to the slip form tube; and finally removal of the tube from the collar so formed.

Additional objects and advantages will become apparent and a note thorough and comprehensive understanding may be had from the following description taken in conjunction with the accompanying drawings forming a part of this specification.

DETAILED DESCRIPTION OF THE INVENTION

Figure 1:
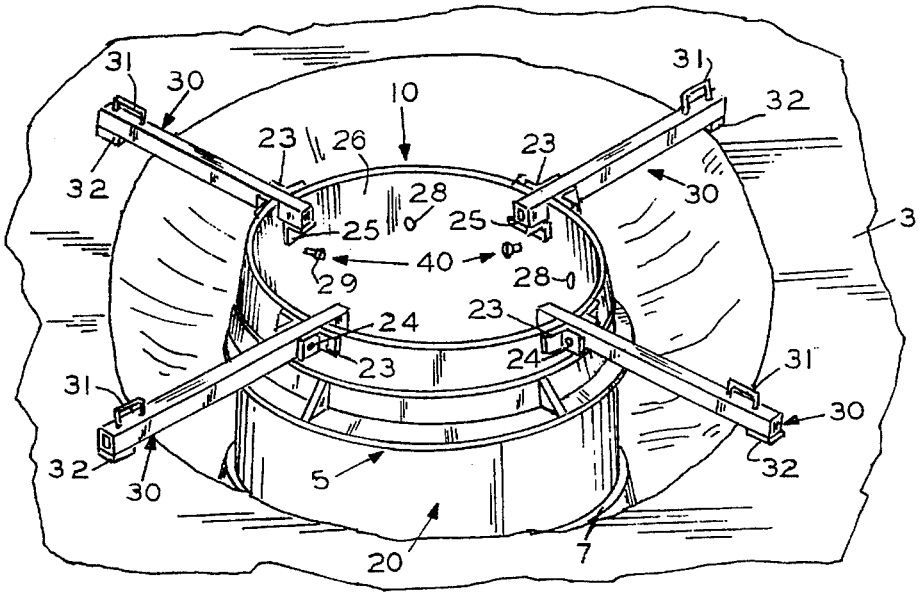
FIG. 1 is a perspective view of the apparatus of the present invention, shown in place for the pouring of concrete.

Referring now to the figures, a preferred embodiment 10 of apparatus for the forming of a manhole collar and the setting of precast manhole ring 5, is shown. Apparatus 10 includes, generally, an elongated slip form tube 20; support arms 30; and fastening means 40 for holding manhole ring 5 to the slip form tube during the concrete pouring process.

Slip form tube 20 may be constructed of any suitable material which is strong enough and rigid enough to support the weight of wet concrete against the outer surface of the tube wall; iron or steel sheeting of one-eighth inch thickness being preferred. Dimensions of the tube may be constructed to suit the user. For standard manholes, a tube, circular in cross-section, having a height of twenty four inches and tapering from a top diameter of 21 ⅛ inches to a bottom diameter of 20 ⅞ inches is used. It is necessary that slip form tube 20 taper from top to bottom for removal of the tube from set or partially set concrete, as will hereinafter be described.

Figure 4:
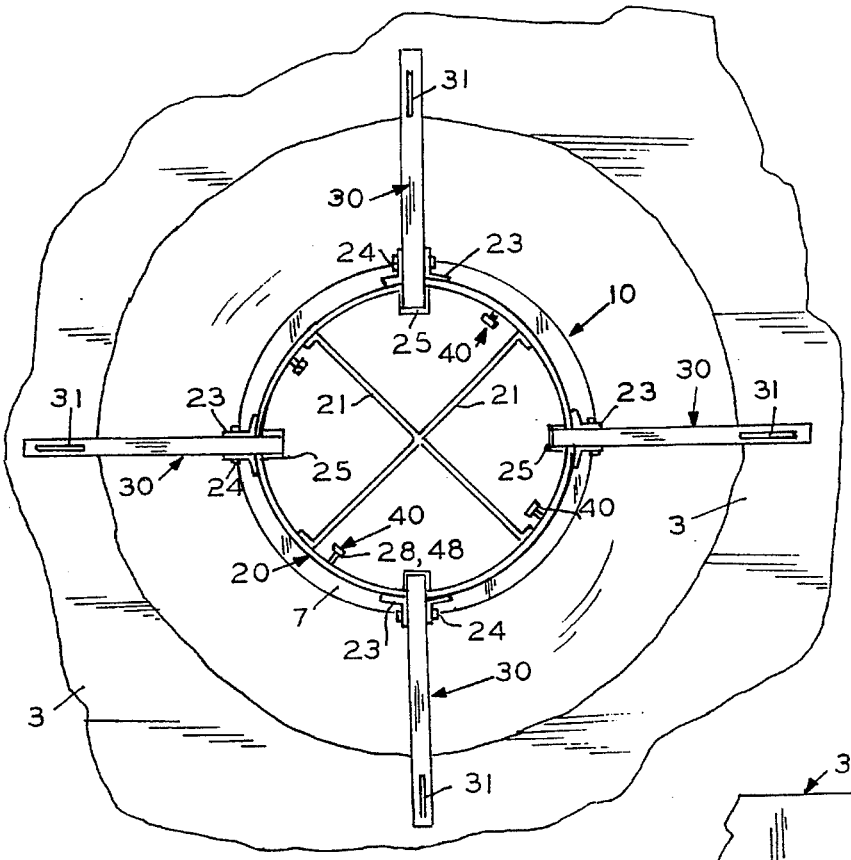
FIG. 4 is a plan view of the apparatus, in place; the manhole ring being absent, for clarity.

For added strength, without the addition of great weight, and for convenience in pulling the slip form tube out of the concrete, reinforcement braces 21 may be provided. Braces 21 may simply comprise a reinforcement ring about the inner surface of the tube or, as shown in FIG. 4, may include cross-bracing attached to opposing points on the interior surface of the tube wall, by suitable fasteners, not shown. While slip form tube 20 is circular in cross section in the preferred version, it is obvious that the tube could be rectangular or define another polygon in cross-section. Further, the apparatus has a primary use for the forming of a manhole collar and for presetting of a precast manhole ring, but may likewise be used for water mains or for providing a collar for other recesses, and therefore the term "manhole"" as used herein and in the appended claims is to be given this broad definition.

Figure 3:
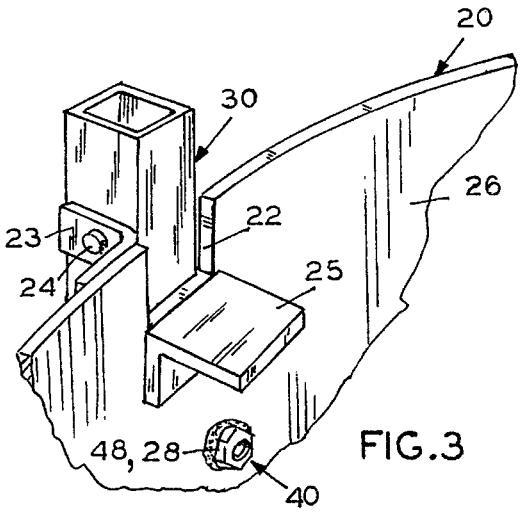
FIG. 3 is a perspective view of a portion of the apparatus, showing a manhole ring fastener; a support shoulder for a support arm; and showing an arm in a pivoted, collapsed position for transport or storage.

Affixed to slip form tube 20 and outwardly extending from the tube are at least two support arms for supporting the slip form tube upon a support surface 3, such as a surrounding asphalt or concrete road surface. Preferably, apparatus 10 includes four arms, equidistantly spaced and radially extending outward from the slip form tube; each arm being provided on its upper surface, adjacent the end of the arm, with a handle 31 so that two workers, standing on opposing sides of the slip form tube, may each grasp two of the handles on adjacent arms, for convenient placement of the tube for pouring of concrete and for removal of the tube from partially set concrete. Arms 30 may be constructed of iron tubing, rectangular in cross-section, each arm being provided with a foot 32, planar on its undersurface, for fitting flush upon the support surface 3. Arms 30 may be of any convenient length so as to extend to the supporting surface, and, in the preferred embodiment shown, each arm is mounted to slip form tube 20 by means of a pair of laterally spaced angle brackets 23, and a pivot pin 24 for pivoting the arm downwardly adjacent the wall of the slip form tube for convenient transportation and storage, as best seen in FIG. 3. For holding the arm in its correct position, perpendicular to the axis of slip form tube 20, during use, as seen in FIGS. 1 and 4, slip form tube 20, on its interior surface, is provided with a shoulder 25, for each respective arm. Each shoulder may be constructed of L-shaped angle iron, welded or otherwise affixed, to the tube wall. Tube 20 also defines a cut-out portion 22, just above each shoulder, for proper pivoting of each arm to its resting position on the shoulder.

For the temporary mounting of a manhole ring 5 about the outer periphery of slip form tube 20, adjacent the top of the tube, is fastening means 40. Fastening means 40 may be of any suitable construction for holding ring 5 to tube 20. In the preferred embodiment shown, fastening means 40 comprises a selected number of apertures 28, preferably equidistantly spaced about the wall of the tube and extending through the tube wall; and each aperture provided with a threaded bolt 29. Apertures 28 may be threaded to accommodate the bolt and/or a threaded nut 48 may be welded to the interior surface 26 of the tube 20, about each aperture to receive the bolt, as seen to advantage in FIG. 5. Each aperture is located approximately six inches below the top rim of the slip form tube, below arms 30, so that bolt properly engage the inner surface 8 of ring 5, which is mounted directly below and abutting the arms 30. It will be understood, then, that each bolt 29 may be rotated to engage ring 5 for clamping the ring to the slip form tube and, likewise, may be rotated in an opposite direction to loosen the ring from the tube.

Figure 2:
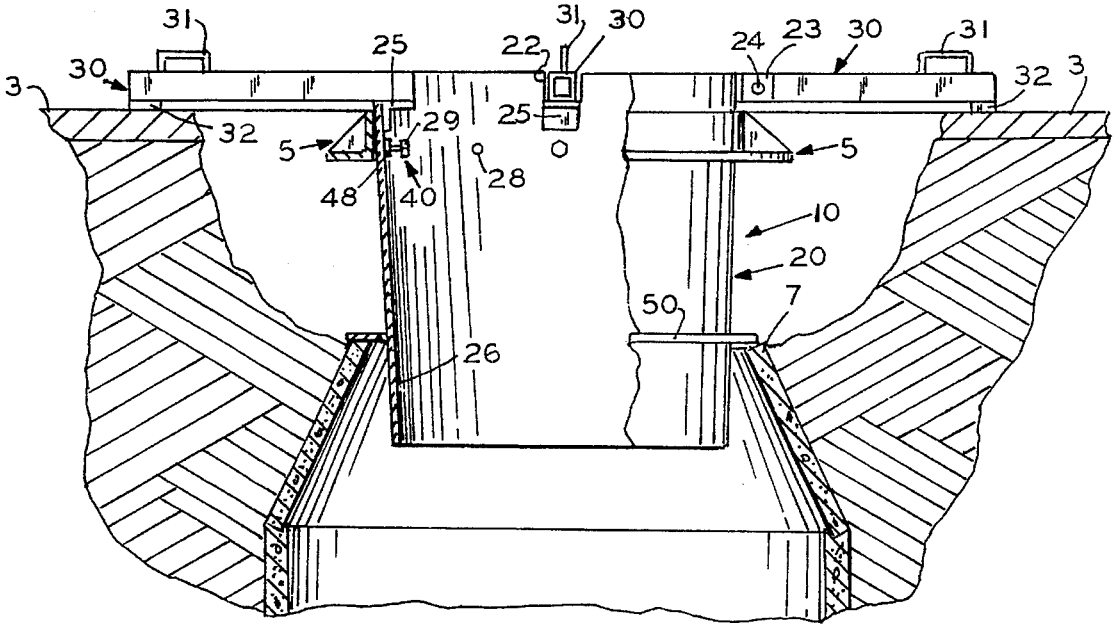
FIG. 2 is a side sectional view of the apparatus, in place for the pouring of concrete.

To prevent concrete from entering manhole cone 7, an annular spill retention ring 50 may be provided. Ring 50 is constructed to have an inner opening of slightly greater diameter than the diameter of slip form tube 20, at the level of placement where the slip form tube enters the manhole cone, as shown in FIG. 2. The ring preferably has planar opposing sides and may be beveled at a forty-five degree angle on the edge of the opening for conveniently receiving slip form tube 20. A small gap may be left between slip form tube 20 and the ring without impairing its ability to prevent concrete from entry into the manhole cone. Ring 50 is optional to the invention, not being needed where measurements between the manhole cone and the slip form tube are snug.

Figure 5:
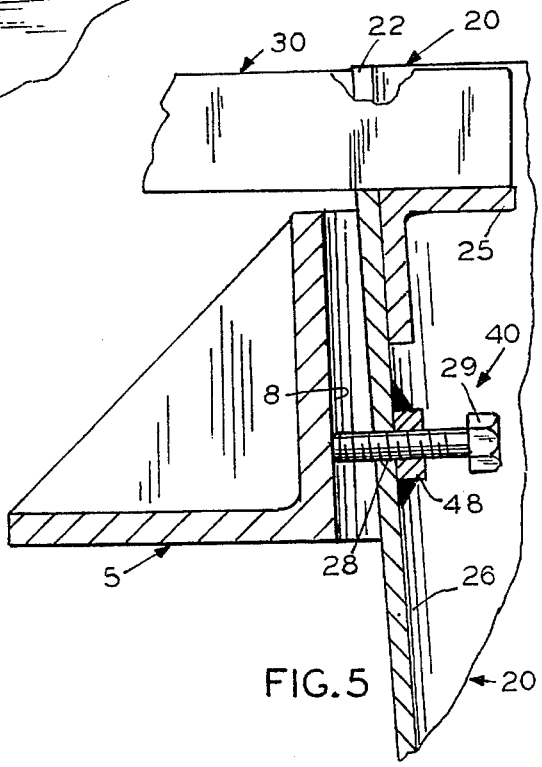
FIG. 5 is a sectional view of a fastener of the present invention, clamping a manhole ring to the slip form tube of the apparatus.

Referring now to FIGS. 1 and 2, in particular, the method of use of apparatus 10 will now be explained, assuming the manhole has been dug; that a manhole barrel, not shown, and manhole cone 7 is in place on top of the barrel; and assuming that the supporting surface has been cleared away for a distance of approximately one foot outwardly from the manhole cone to form a void. First, the manhole slip form tube 20, with arms 30 radially extended, is placed upon a level surface in an inverted position, ie., with the top surfaces of the arms and the top rim of the tube against the level surface. A precast manhole ring 5 is then placed about the outer periphery of the slip form tube, resting in an also inverted position on support arms 30. Fastening means 40 are then caused to engage the manhole ring 5 to clamp the ring to the tube. In the embodiment shown, this is accomplished by rotating bolts 29 until each of the bolts firmly engage the interior surface 8 of ring 5, as seen in FIG. 5.

Once ring 5 is sufficiently fastened, the apparatus is again inverted to the position shown in FIG. 2 and, by grasping handles 31 of arms 30, two workers gently lower the slip form tube 20 into the top opening of the manhole cone, as shown in the FIG. The slip form tube is thus lowered until feet 32 of arms 30 rest upon support surface 3 surrounding the void. It will be noted, then, that the slip form tube is positioned within the manhole cone, and that the manhole ring is held in position, axial with and at a selected level and height above the manhole cone. The dimensions of apparatus 10 are preferably such that the top of the manhole ring is one-quarter inch below the surface of the surrounding asphalt or concrete to make the manhole cover, not shown, flush with the road surface, when in place.

If it appears that too large of gap exists between the slip form tube 20 and the inner rim of manhole cone 7, retention ring 50 may be placed over the top of the cone before lowering the slip form tube into place within the opening of the ring and within the opening of the manhole cone.

Once apparatus 10 is in place, concrete is poured into the void surrounding the slip form, tamped, and brought up to level. Reinforcement bars may be used as desired or required. Once poured and tamped, the concrete will form a smooth solid collar about slip form tube 20, embedding manhole ring 5 in place at the precise level. It will be noted that this process eliminates the need for manhole risers; eliminates the need for spacers to bring the manhole ring to the exact height; and eliminates the time and hence cost of intricate and exact spacing of the risers and the manhole ring.

After the concrete is partially set, fastening means 40 is loosened to free slip form tube 20 from its engagement with manhole ring 5 and the workers again grasp handles 31 and pull upwardly to free the slip form tube from the collar thus formed and the embedded manhole ring. The apparatus is then washed and arms 30 may be pivoted downwardly against the outside of the slip form tube 20 for transporting and storage. Where spill retention ring 50 has been used, the ring remains in place between the collar and the manhole cone.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Manhole slip form apparatus for constructing a manhole collar of concrete comprising:

an elongated slip form tube, tapering in cross-sectional area from, a first end to a second end, for placement within a manhole cone such that said first end and said second end define a top end and a bottom end, respectively, of said placed slip form tube;

at least two arms mounted to and outwardly extending from said top end of said slip form tube for holding said tube at a selected height within said manhole cone by resting said arms upon a support surface; and fastening means for holding a precast manhole ring about an exterior periphery of said slip form tube during pouring of concrete about said slip form tube to form said collar extending between said manhole cone and said precast manhole ring with concrete collar embeds said precast manhole ring at a selected level relative to said support surface and said manhole cone.

2. The apparatus as described in claim 1 wherein said slip form tube is circular in cross-section.

3. The apparatus as described in claim 1 wherein said apparatus is provided with four arms, equidistantly spaced and radially extending from said slip form tube.

4. The apparatus as described in claim 3 wherein each of said arms is pivotally mounted to said slip form tube for placement adjacent and substantially parallel to said slip form tube for storage.

5. The apparatus as described in claim 3 wherein each of said arms is provided with a handle for maneuvering of said apparatus, with said manhole ring attached thereto, into a collar forming position and for lifting said apparatus from said collar forming position.

6. The apparatus as described in claim 1 wherein said fastening means comprises a plurality of threaded apertures and a plurality of threaded bolts, each of said bolts matingly engaging a respective aperture and extending through a wall of said slip form tube for contacting said precast manhole ring for clamping said precast manhole ring to said slip form tube.

7. The apparatus as described in claim 1 further comprising a spill retention ring, having a planar undersurface for placement upon said manhole cone and about said exterior periphery of said slip form tube for preventing poured concrete from entering said manhole cone.

8. The apparatus as described in claim 1 further comprising brace means located within said slip form tube to prevent inward collapse of said slip form tube.

9. Manhole slip form apparatus for constructing a manhole collar of concrete comprising:

an elongated slip form tube, circular in cross-section, and tapering in cross-sectional area from a first end to a second end, for placement within a manhole cone such that said first end and said second end define a top end and a bottom end, respectively, of said placed slip form tube, four arms mounted to and radially outwardly extending from said top end of said slip form tube holding said tube at a selected height within said manhole cone by resting said arms upon a support surface, each of said arms provided with a handle for maneuvering of said apparatus, with attached precast manhole ring, into a collar forming position and for lifting said apparatus from said collar forming position; and fastening means for holding said precast manhole ring about an exterior periphery of said slip form tube during for pouring of concrete about said slip form tube to form said collar extending between said manhole cone and said precast manhole ring and which concrete collar embeds said precast manhole ring at a selected level relative to said support surface and said manhole cone.

10. The apparatus as described in claim 9, wherein each of said arms is pivotally mounted to said slip form tube for placement adjacent and substantially parallel to said slip form tube for storage.

11. The apparatus as described in claim 9 wherein said fastening means comprises a plurality of threaded apertures and a plurality of threaded bolts, each of said bolts matingly engaging a respective aperture and extending through a wall of said slip form tube for contacting said precast manhole ring for clamping said precast manhole ring to said slip form tube.

12. The apparatus as described in claim 9 further comprising a spill retention ring, having a planar undersurface for placement upon said manhole cone and about said exterior periphery of said slip form tube for preventing poured concrete from entering said manhole cone.

13. The apparatus as described in claim 9 further comprising brace means located within said slip form tube to prevent inward collapse of said slip form tube.

14. A method for constructing a manhole collar upon a manhole cone, utilizing a precast manhole ring, said method comprising the steps of:

supporting an elongated slip form tube, tapering downwardly in cross-sectional area from a first end to a second end, within a manhole cone by means of at least two arms outwardly extending from said tube and resting upon a support surface, such that said first end and said second end define a top end and a bottom end, respectively, of said supported slip form tube;

Fastening a precast manhole ring to said tube, about an outer periphery of said tube;

leveling said tube and said fastened precast manhole ring at a selected height relative to said support surface and said manhole cone;

pouring concrete about said leveled slip form tube to construct said manhole collar extending between said manhole cone and said precast manhole ring and to embed said precast manhole ring within said concrete collar at said selected height relative to said support surface and said manhole cone;

loosening said precast manhole ring from said tube; and removing said slip form tube from said precast manhole ring and from said collar thus formed.

15. The method as described in claim 14, further comprising the step of placing a spill retention ring upon said manhole cone and around said outer periphery of said slip form tube to prevent said poured concrete from entering said manhole cone.

* * * * *